United States Patent [19]

Mercurio

[11] Patent Number: 4,592,659

[45] Date of Patent: Jun. 3, 1986

[54] TIMER FOR COIN OPERATED DEVICES

[75] Inventor: Leonard Mercurio, Dix Hills, N.Y.

[73] Assignee: Set-O-Matic, Inc., Burnside, N.Y.

[21] Appl. No.: 713,256

[22] Filed: Mar. 18, 1985

[51] Int. Cl.[4] ..... G04F 8/00

[52] U.S. Cl. ..... 368/1

[58] Field of Search ..... 368/1, 7, 8, 10, 89–93; 194/9 T, DIG. 17, DIG. 18, DIG. 22; 221/9, 15; 222/638–641, 644

[56] References Cited

U.S. PATENT DOCUMENTS 3,429,121 2/1969 Parker ..... 368/1

*Primary Examiner*—Vit W. Miska

*Attorney, Agent, or Firm*—Charles E. Temko

[57] ABSTRACT

An improved motorized timer for coin operated devices utilizing a spring slip clutch. A single motor drives a single rotating cam which controls first and second switches, a first of which controls operation of the timer motor, and a second of which controls operation of the appliance.

1 Claim, 3 Drawing Figures

TIMER FOR COIN OPERATED DEVICES

BACKGROUND OF THE INVENTION

This invention relates generally to the field of coin-operated devices, and more particularly, to an improved cycle-initiating means for use with such appliances as well as vending machines having cyclic operation initiated by movement of a coin slide.

In typical instructions, a timer motor drives a gear train to determine the effective length of time to complete a single cycle. Such devices normally include an internally positioned gear clutch associated with the motor. These clutches are relatively expensive, and not always readily accessible for repair when required.

SUMMARY OF THE INVENTION

Briefly stated, the invention contemplates the provision of an improved timing mechanism initiated by operation of a coin slide and utilizing a spring slip clutch which permits a novel mode of operation. The gear train drives a single cam member having first and second sets of cams each set operating one of first and second switches, a first switch of which controls the operation of the timing motor, and a second of which controls the operation of the associated appliance or vending machine. The cam will is initially positioned by operation of the coin slide which can be moved independently of the motor by virtue of a slip clutch. When the motor commences operation, the clutch is resiliently engaged whereby the motor moves the cam wheel to the position of next operation.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
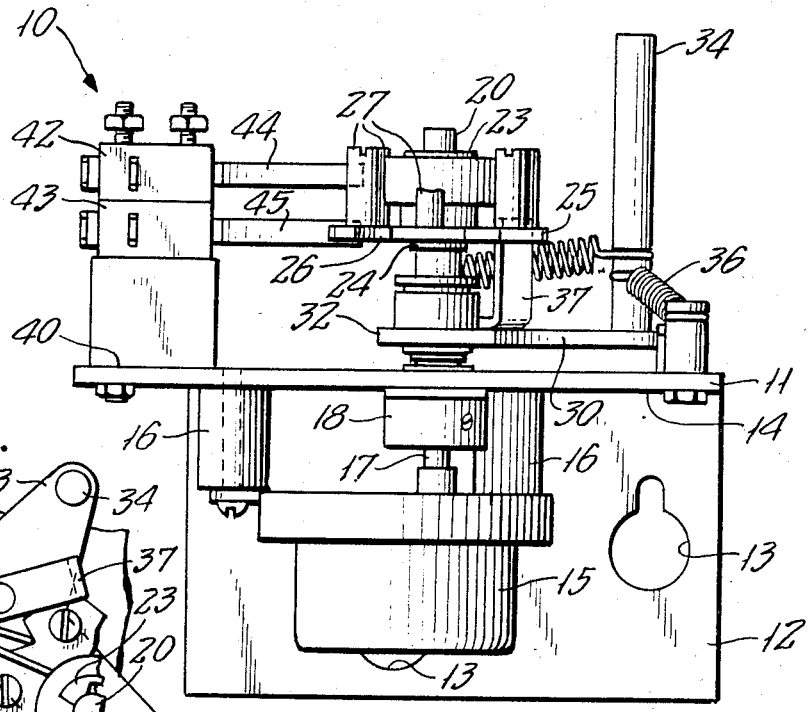
FIG. 1 is a side elevational view of an embodiment of the invention.
Figure 3:
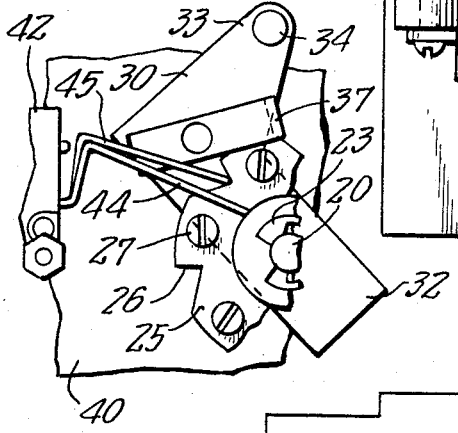
FIG. 3 is a fragmentary top plan view, corresponding to that seen in FIG. 2, with certain of the component parts in altered relative position.
Figure 2:
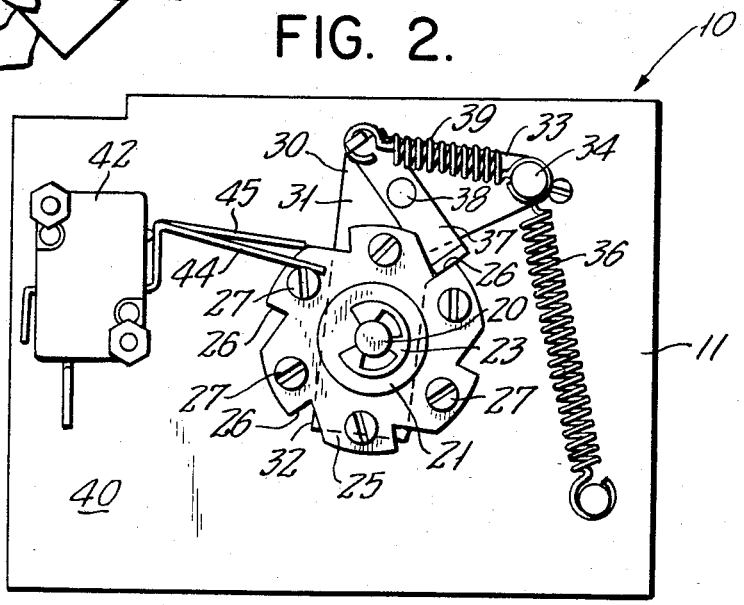
FIG. 2 is a top plane view thereof.

In accordance with the invention, the device, generally indicated by reference character 10, comprises broadly: a mounting plate 11 having an angularly disposed flange 12 defining mounting holes 13 whereby the plate 11 may be fixed in an installed position. Mounted on an undersurface 14 of plate 11 is a timing motor 15, of known type incorporating a gear train (not shown). The motor 15 is supported by mounting brackets 16, whereby an output shaft 17 engages a set screw coupling 18 on a shaft 19.

The shaft 19 terminates at an opposite end 20 in a hollow cap 21 incorporating a spring washer 22 held in position by a retaining washer 23. A collar 24 surrounding the shaft 19 mounts a ratchet wheel 25 having ratchet indentations 26 and a corresponding number of laterally projecting pins 27.

Mounted for rotation on the shaft 19 is a pawl element 30 including a plate 31, a first end 32 of which is carried by the shaft 19. A second end 33 mounts an upstanding pintle 34 selectively engagable by a coin slide (not shown). A return spring 36 urges the element 30 in a clockwise direction on withdrawal of the coin slide, whereby a pawl member 37 will engage one of the indentations 26 to be advanced a predetermined angular distance. The pawl member 37 is supported by a mounting pintle 38, and is urged into engagement with an indentation 26 by a pawl spring 39.

Mounted on an upper surface 40 of the plate 31 are first and second precision switches 42 and 43, each including an operating lever at 44 and 45, respectively. As best seen in FIG. 1, lever 44 is adapted to contact the pins 27 while the lever 45 contacts the periphery of the wheel 25 and the ratchet indentations 26 thereon.

Operation of the device will be apparent for my consideration of the drawing. In the "Off" condition, that is to say when the coin operation device is not in operation, both switches 42 and 43 are opened. Upon the insertion of a coin in a coin slide, and movement thereof, the slide pushes the upstanding pintle 34 so that the pawl member 37 engages one of the ratchet indentations or teeth 26. When the slide is retracted, the spring 36 will advance the device to the on position which is determined by engagement with a stop post 41.

With this action, both switches 42 and 43 closed. Closing the switch 42 allows current to the coin operated device (not shown), while the closing of switch 43 allows current to flow to the timing motor. It opens to a position for the next cycle of operation.

I wish it to be understood that I do not consider the invention limited to the precise details of structure shown and set forth in this specification, for obvious modifications will occur to those skilled in the art to which the invention pertains.

I claim:

1. In an improved timing device for use with a coin-operated appliance, including a timing motor driving a gear train, the improvement comprising: a first motor output shaft, resilient slip clutch means engaging said output shaft, a ratchet wheel driven by said slip clutch means said wheel including a plurality of ratchet teeth and a corresponding number of pins extending laterally therefrom; first and second switches, said first switch controling said motor, said second switch controling operation of an associated appliance; each of said switches having an operating lever, one of said levers being moved by contact with the periphery of said ratchet wheel, the other said switches being moved by contact with corresponding pins; an orbitally mounted pawl surrounding said slip clutch means, said ratchet wheels being advanced to starting position by movement of said pawl in response to movement of a coin slide.

* * * * *